US005142332A

United States Patent [19]

Osawa et al.

[11] Patent Number: 5,142,332

[45] Date of Patent: Aug. 25, 1992

[54] IMAGE FORMING APPARATUS INCLUDING TONER SUPPLEMENT MEANS

[75] Inventors: Keishi Osawa, Yokohama; Hideki Adachi, Kawasaki, both of Japan

[73] Assignee: Canon Kabushiki Kaisha, Tokyo, Japan

[21] Appl. No.: 533,586

[22] Filed: Jun. 5, 1990

[30] Foreign Application Priority Data

Jun. 7, 1989 [JP] Japan ..... 1-146443

[51] Int. Cl.[5] ..... G03G 15/08; G03G 15/00

[52] U.S. Cl. ..... 355/208; 355/246

[58] Field of Search ..... 355/208, 246, 204

[56] References Cited

U.S. PATENT DOCUMENTS

| | | | |
|---|---|---|---|
| 3,814,516 | 6/1974 | Whited | 355/246 |
| 4,607,944 | 8/1986 | Rushing | 355/246 |
| 4,833,506 | 5/1989 | Kuru et al. | 355/208 |
| 4,875,078 | 10/1989 | Resch, III | 355/246 |
| 4,880,142 | 11/1989 | Higachi et al. | 222/56 |
| 4,942,431 | 7/1990 | Tada | 355/246 |

FOREIGN PATENT DOCUMENTS

| | | | |
|---|---|---|---|
| 57-146263 | 9/1982 | Japan | 355/246 |
| 59-155866 | 9/1984 | Japan | 355/246 |
| 60-229073 | 11/1984 | Japan | 355/246 |
| 60-84557 | 5/1985 | Japan | 355/246 |
| 62-24286 | 2/1987 | Japan | 355/246 |
| 62-25777 | 2/1987 | Japan | 355/246 |
| 62-118373 | 5/1987 | Japan | 355/246 |
| 2141050 | 12/1984 | United Kingdom | 355/208 |

*Primary Examiner*—Joan H. Pendegrass

*Attorney, Agent, or Firm*—Fitzpatrick, Cella, Harper & Scinto

[57] ABSTRACT

The present invention relates to a developing device in an image forming apparatus which uses electrophotography, and more particularly, to a developing device which use fuzzy inferring to control a supply of a developer and provides an optimal developer supply even if a plurality of state quantities exist. Furthermore, the present invention relates to an image forming apparatus which adopts such a developing device using the fuzzy inferring.

16 Claims, 10 Drawing Sheets

IMAGE FORMING APPARATUS INCLUDING TONER SUPPLEMENT MEANS

BACKGROUND OF THE INVENTION

1. Field of the Invention

The present invention relates to a developer supply technique for use in a developing device which develops an electrostatic image by a developer in an electrophotographic copying machine or an electrophotographic laser beam printer. Furthermore, the present invention relates to an image forming apparatus, such as an optical printer and for example, a copying machine or an electrophotographic laser beam printer, which adopts a developing device utilizing such a developer supply technique.

2. Related Background Art

Among conventional developer supply devices of this type, a developer supply device is generally known which detects a toner amount (a mixture ratio of a carrier and a toner in the case of using a two-component developer) in a developing device by sensing permeability, reflectance or change in the amount of the toner and controls a toner supply amount from the side of a toner hopper so as to maintain a constant toner amount. For example, in case the reflectance is measured with a two-component developer, a method, which performs the following control operation, is adopted in order to maintain the amount of the toner in the developer: since the reflectance will vary in accordance with the mixture ratio of a carrier and a toner, a photodiode receives the light reflected from the developer and the output voltage of the photodiode is compared with a predetermined standard voltage. If the output voltage is lower than the standard voltage, a toner is supplied from a toner hopper for a predetermined period or in a predetermined amount, and if the output voltage is equal to or higher than the standard voltage, the toner supply is stopped.

However, as for the toner amount control of a toner supply device in an image forming apparatus, such as a copying machine, if the state quantity, such as room temperature, humidity, the number of copy sheets, document density and so on is changed, it is impossible to obtain a sufficient image only by supplying a toner of a constant amount or of an amount so as to increase the output voltage to the standard voltage.

If the density of an original is high and the number of copy sheets is large, the amount of toner consumed in the developer is large. Accordingly, the toner supply from a toner hopper cannot keep up with the amount of toner consumed and this sometimes causes a serious image defect, such as lowering of the image density, and, in an extreme case, a white blank or void wherein a part of the image does not exist. On the other hand, if the amount of the toner supplied from the toner hopper for a predetermined period is increased in order to adapt to the above-described condition, or reversely, if the control is made to supply the toner when the smaller amount of toner is consumed, too much toner is contained in the developer and this causes a deterioration of the image, such as a change in the image density, or, in an extreme case, blooming.

Furthermore, if the humidity and/or temperature inside the image forming apparatus is changed, the flowability or charging characteristics of the toner are also changed. Therefore, even if a constant amount of toner is supplied in response to the change in the toner density, the quality of the developed image is sometimes changed. In addition, if deterioration of the toner or the carrier, that is, the developer, and so on is caused by long-term use of the image forming apparatus, a similar problem also sometimes arises.

SUMMARY OF THE INVENTION

An object of the present invention is to provide a toner supply technique having high precision.

Another object of the present invention is to provide a toner supply technique which enables an optimal toner supply in consideration of one or a plurality of conditions.

Another object of the present invention is to provide a toner supply technique which enables a toner supply to adapt to a condition existing at that time in a simple control manner.

Still another object of the present invention is to provide an image forming apparatus which prevents a white blank, blooming and so on from arising by properly supplying toner and forms a toner image of high quality.

In order to achieve the above objects, the present invention provides a developing device for developing a latent image formed on an image bearing member, which comprises a state quantity detection means for detecting a state quantity for supplying a developer, a memory means for storing the relationship between a control quantity for controlling a developer supply mechanism and the above state quantity as a rule so as to supply the developer into a developer container in the developing device, and an inferring means for inferring the control quantity to be found from the state quantity, based on the rule stored in the above memory means, controls the control quantity of the developer supply means, and supplies the developer having an amount corresponding to the above state quantity. Furthermore, the present invention provides an image forming apparatus which utilizes such a developing device.

DETAILED DESCRIPTION OF THE PREFERRED EMBODIMENTS

Figure 1:
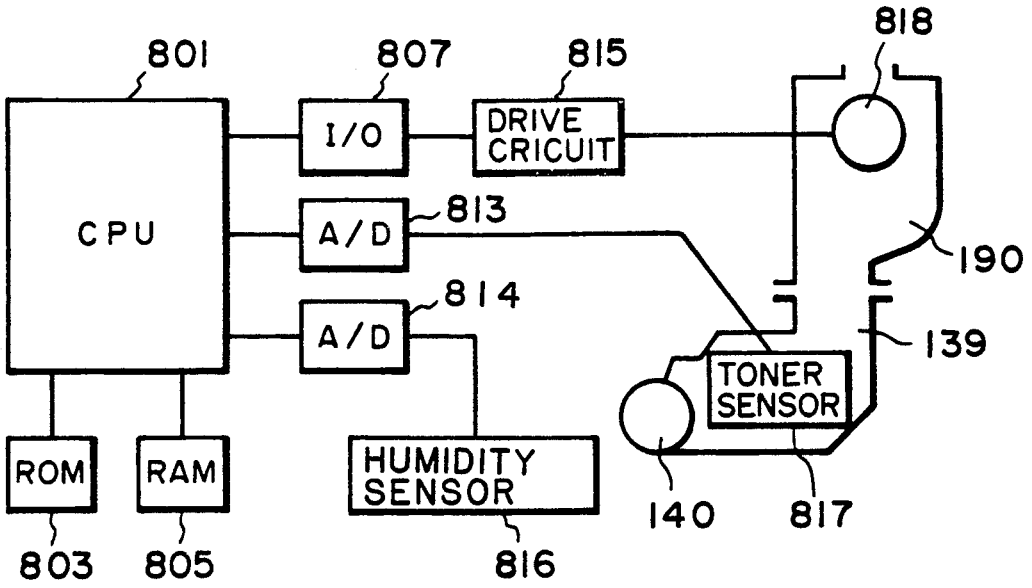
FIG. 1 is a block diagram of a control circuit according to an embodiment of the present invention.

Referring to the drawings, embodiments of the present invention will be explained in detail hereinafter.

FIG. 1 is a basic block diagram of a toner supply device of the present invention. In FIG. 1, 801 is a central processing unit (CPU), described below, which actually executes fuzzy inferring. 803 is a read-only memory (ROM), described below, which stores a rule and a membership function for fuzzy control. 805 is a random-access memory (RAM), described below, which is used as a calculation operating area for executing the fuzzy inferring. 807 is a port, 813 and 814 are A/D converters which convert an analog signal to a digital signal, 140 is a developing roller, 139 is a developing device, 190 is a hopper which contains a toner, 818 is a DC motor which drives a roller 818' for transporting the toner from the hopper into the developing device, 815 is a drive circuit which drives the DC motor, 817 is a toner sensor which senses the amount (density) of the toner in the developing device, and 816 is a humidity sensor which senses the humidity inside an image forming apparatus. The output of each of the sensors 816 and 817 is input to the A/D converters 813 and 814 as a voltage value.

The CPU 801 generates a well-known PWM drive pulse through the port 807 and controls the speed of the DC motor 818 through the drive circuit 815. In order to rotate the DC motor 818 at 30 rpm, a duty cycle of the PWM drive pulse may be 50%. At this time, a toner of 50 g is transported from the hopper 190 into the developing device 139 for a minute.

Figure 2:
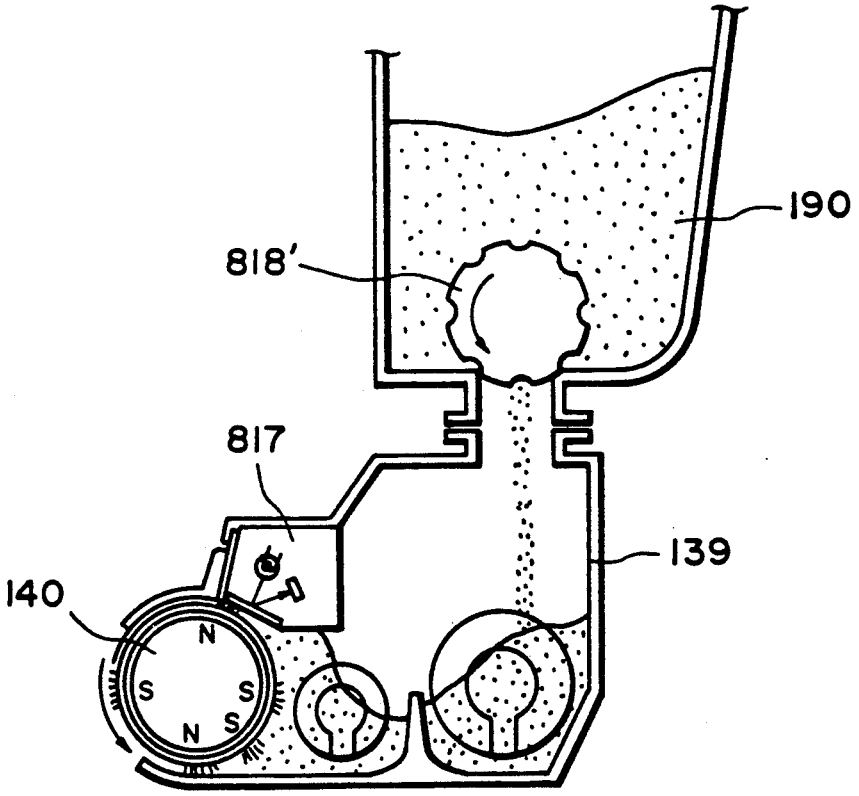
FIG. 2 is a view explaining a developing device to which the present invention can be applied.

Next, the developing device 139 and the toner supply device 190 of the invention will be explained with reference to FIG. 2. The developing device 139 comprises a developer bearing member 140, the toner density detection device 817 and a developer agitation/transport device having two screws. A two-component developer which is composed of a carrier and a non-magnetic toner is used. The developer is transported to the side of the image bearing member, such as an electrophotographic photosensitive member, in correlation to the rotation of a non-magnetic sleeve comprising a magnet fixed in the developer bearing member 140, a magnetic brush is formed by development magnetic poles, and then a latent image is developed.

At this time, the motor 818 and the toner transport roller 818' of the toner supply device 190 are driven by detecting the toner density in the developer by means of the toner density detection device 817 mounted opposite to the developer bearing member which compares the detected toner density, based on the light reflected by the toner, with a standard level value in the CPU of a main body of the toner supply device. The toner transport roller 818', which is a cylindrical rotatable member having grooves, takes the non-magnetic toner into the grooves and transports and supplies the toner onto the two screws of the developing device 139 during its rotation. Then, the developer and the non-magnetic toner are sufficiently agitated and mixed by the two screws and the developer is again transported and supplied to the developer bearing member 140 for development.

The toner density detection device detects the amount of the reflected light as the amount of the toner in the developer and photoelectrically converts that amount to a converted value. The converted value is then compared with a standard photoelectrical converted value, which is converted from analog to digital in the CPU 801 beforehand, of the amount of the toner in the developer. If the output value is higher than the standard value, the toner is not supplied, and in a contrary case, the toner is supplied. In the present embodiment, an initial set value (standard value) of the amount of the toner in the developer is 25 g to 300 g of the developer and 128 in a digital value. When the digital value is 0, the amount of the toner is set 0 g, and when the digital value is 255, the amount of the toner is set 50 g.

It is natural that the amount of reflected light obtained by the toner density detection device is directly proportional to the digital value obtained by the A/D conversion.

The present invention will be specifically explained, hereinafter, not with the photo-electrical converted analog value of the toner density detection device, but with the calculated amount of the toner in the developer.

Next, the toner supply control operation of the toner supply device according to the present invention will be described. As state quantities for controlling the toner supply, the following three state quantities are used:

(i) Toner consumption deviation means the difference between the amount (density) of existing toner in the developing device and the target amount (density) of toner (ii) Toner consumption grade which is the change in the amount of toner consumed per unit time (iii) Humidity inside of the image forming apparatus Naturally, (ii) is the value relating to the document density, the size of recording paper and so on.

As the control quantity for controlling the toner supply, the following quantity is used:

(iv) Deviation of the toner supply speed (rotational speed of the roller 818')

Figure 3A:
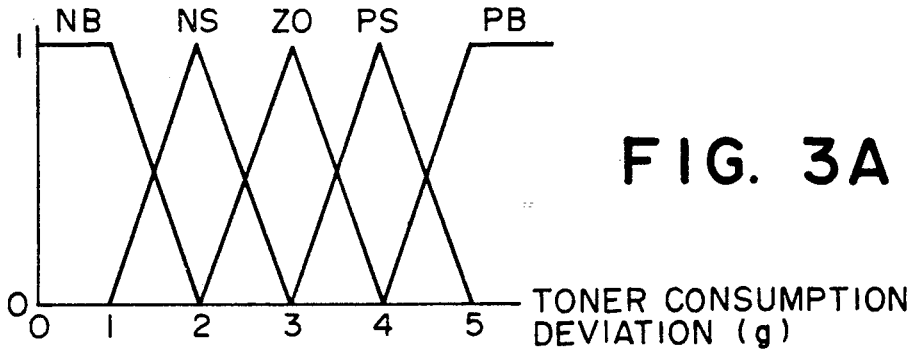
FIGS. 3A to 3D are views explaining membership functions.
Figure 3B:
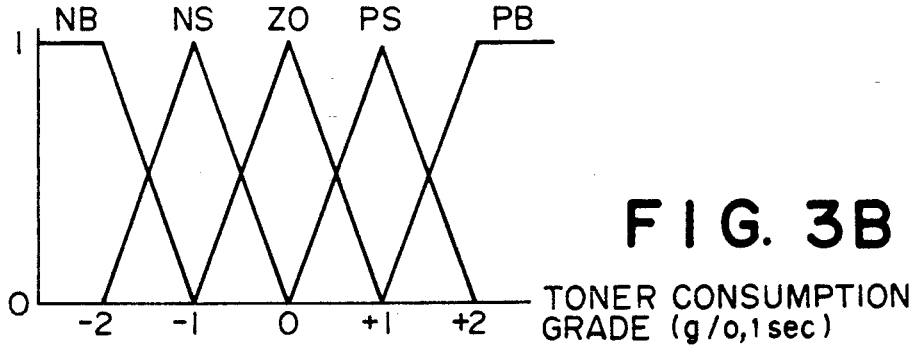
Figure 3C:
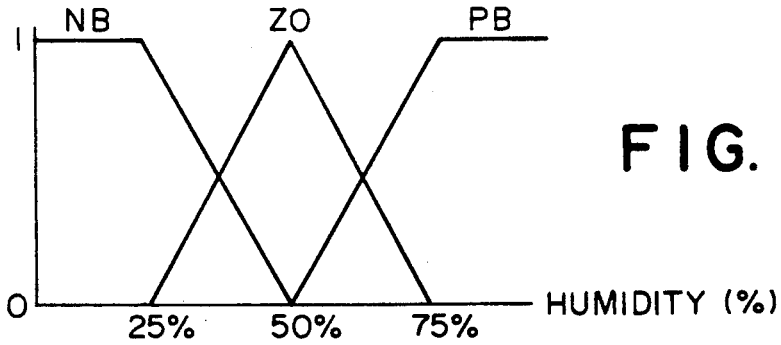
Figure 3D:
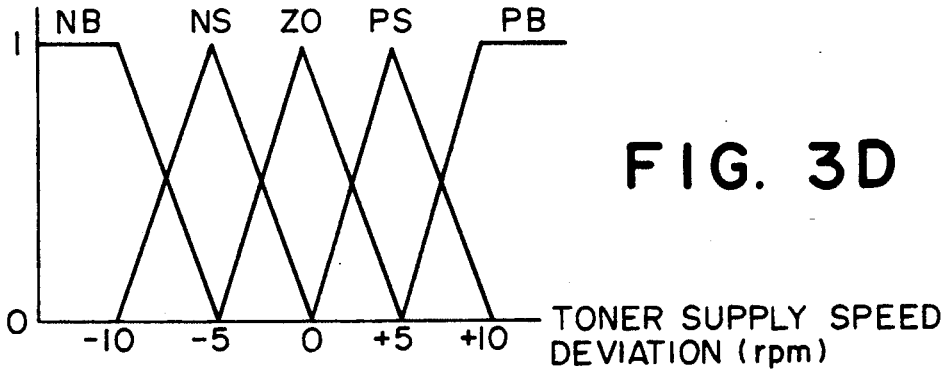

FIGS. 3A to 3D show fuzzy sets called membership functions of the above status and control quantities (i) to (iv). The toner consumption deviation, the toner consumption grade, the inside humidity and the toner supply speed deviation respectively are roughly divided into several sets, for example, the following five sets:

1) NB (Negative Big)
   A negative value whose absolute value is large
2) NS (Negative Small)
   A Negative value whose absolute value is small
3) ZO (Zero)
   A value near 0
4) PS (Positive Small)
   A positive value whose absolute value is small
5) PB (Positive Big)
   A positive value whose absolute value is large The degree to which a quantity belongs to each set is indicated by a value 0 to 1. FIG. 3A shows a membership function of the toner consumption deviation, FIG. 3B shows a membership function of the toner consumption grade, FIG. 3C shows a membership function of the inside humidity, and FIG. 3D shows a membership function of the toner supply speed deviation.

Taking ZO (Zero) shown in FIG. 3A as an example, when the toner consumption deviation is 0 g, the degree to which it belongs to the set ZO is 0. When the toner consumption deviation is 2.5 g or 3.5 g, the degree is 0.5. Other sets are the same as ZO.

Next, a method of calculating the toner supply speed deviation from the state quantities of the toner consumption deviation, the toner consumption grade and the inside humidity will be described.

In order to determine the toner supply speed deviation, for example, the following fuzzy rules are used:

(Rule 1)

If the toner consumption deviation=PB, the toner consumption grade=ZO, and the inside humidity=ZO, then, the toner supply speed deviation=PB.

(Rule 2)

If the toner consumption deviation = PS, the toner consumption grade = ZO, and the inside humidity = ZO, then, the toner supply speed deviation = PS.

Thus, the fuzzy rules are set according to requirements. The fuzzy rules in this case are shown in Table 1:

TABLE 1

| |
|---|
| (E is PB and DE is ZO and SP is ZO) → H is PB |
| (E is PS and DE is ZO and SP is ZO) → H is PS |
| (E is ZO and DE is ZO and SP is ZO) → H is ZO |
| (E is ZO and DE is PB and SP is ZO) → H is NB |
| (E is ZO and DE is PS and SP is ZO) → H is NS |
| (E is ZO and DE is ZO and SP is ZO) → H is ZO |
| (E is ZO and DE is NS and SP is ZO) → H is PS |
| (E is ZO and DE is NB and SP is ZO) → H is PB |
| (E is ZO and DE is ZO and SP is PB) → H is PS |
| (E is ZO and DE is ZO and SP is NB) → H is NS |

As shown in Table 1, E denotes the toner consumption deviation, DE denotes the toner consumption grade, SP denotes the humidity and H denotes the toner supply speed deviation.

Figure 4:
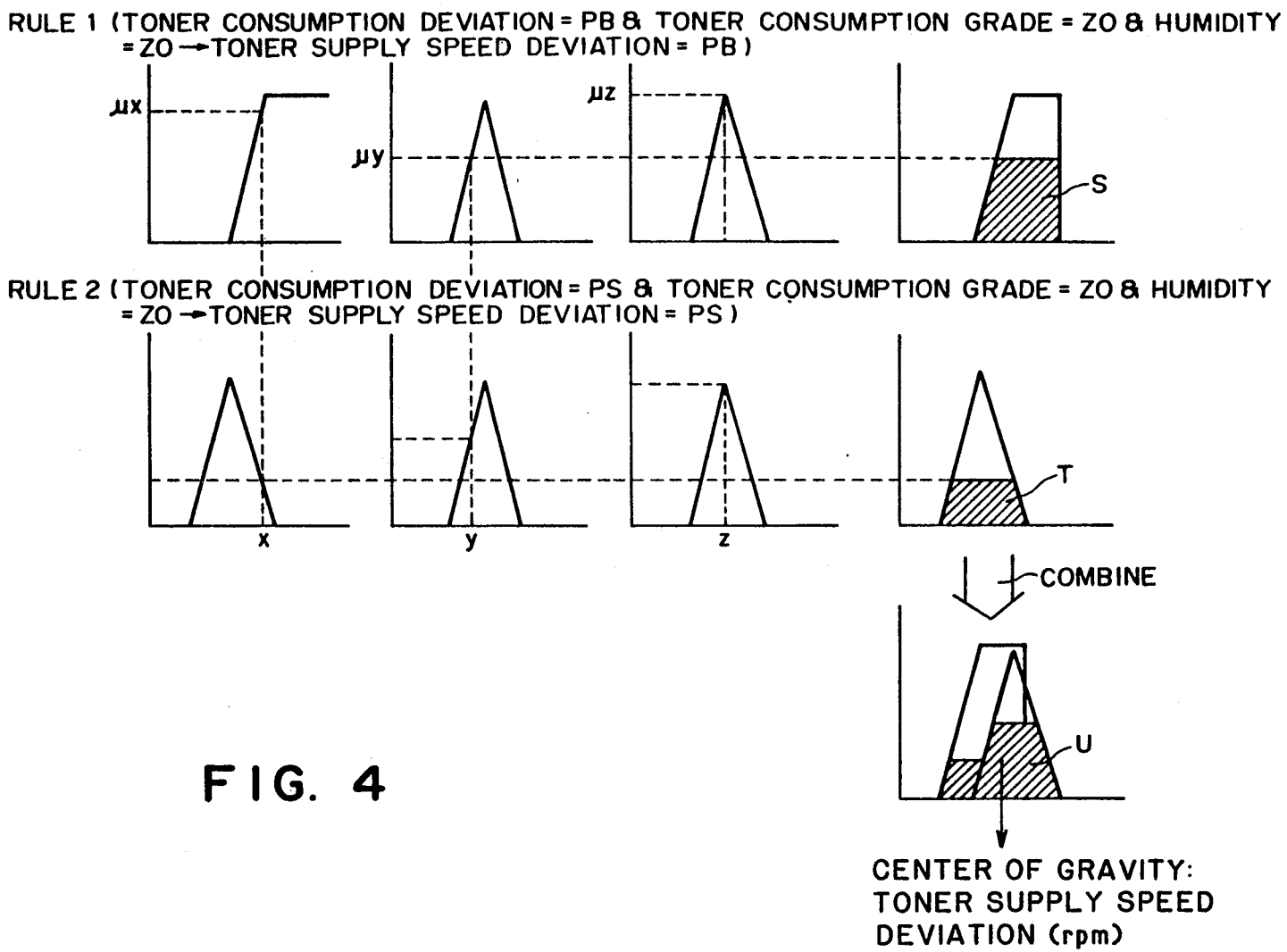
FIG. 4 is a view explaining a calculation.

FIG. 4 shows an example of calculating the toner supply speed deviation by the fuzzy inferring with the above Rule 1 and Rule 2.

The case that the toner consumption deviation = x, the toner consumption grade = y, and the inside humidity = z is taken as an example.

In Rule 1, the degree to which input x is contained in the set PB is $\mu x$ according to the membership function of the toner consumption deviation, the degree to which input y is contained in the set ZO is $\mu y$ according to the membership function of the toner consumption grade, and the degree to which input z is contained in the set ZO is $\mu z$ according to the membership function of the inside humidity.

The minimum value is selected from $\mu x$, $\mu y$ and $\mu z$, a calculation is performed so as to find the minimum value of the above value and the membership function of the toner supply speed deviation, and then, a shaded trapezoid portion S is obtained.

The same calculation is also executed in Rule 2 and a shaded trapezoid portion T is obtained. After that, by combining the sets S and T and selecting the maximum value of the combined set, a new set, shown as a shaded portion U, is obtained. A value obtained by calculating the center of gravity of the set is set as the toner supply speed deviation obtained by the fuzzy inferring.

In the foregoing case only Rule 1 and Rule 2 have been explained above in order to make the explanation brief. However, the calculation is actually performed for each rule shown in Table 1 to find each set, a new set is calculated by taking the maximum value of each set, and the center of gravity of the new set is calculated as the toner supply speed deviation. The motor 818 is driven at a speed corresponding to the deviation.

Figure 5:
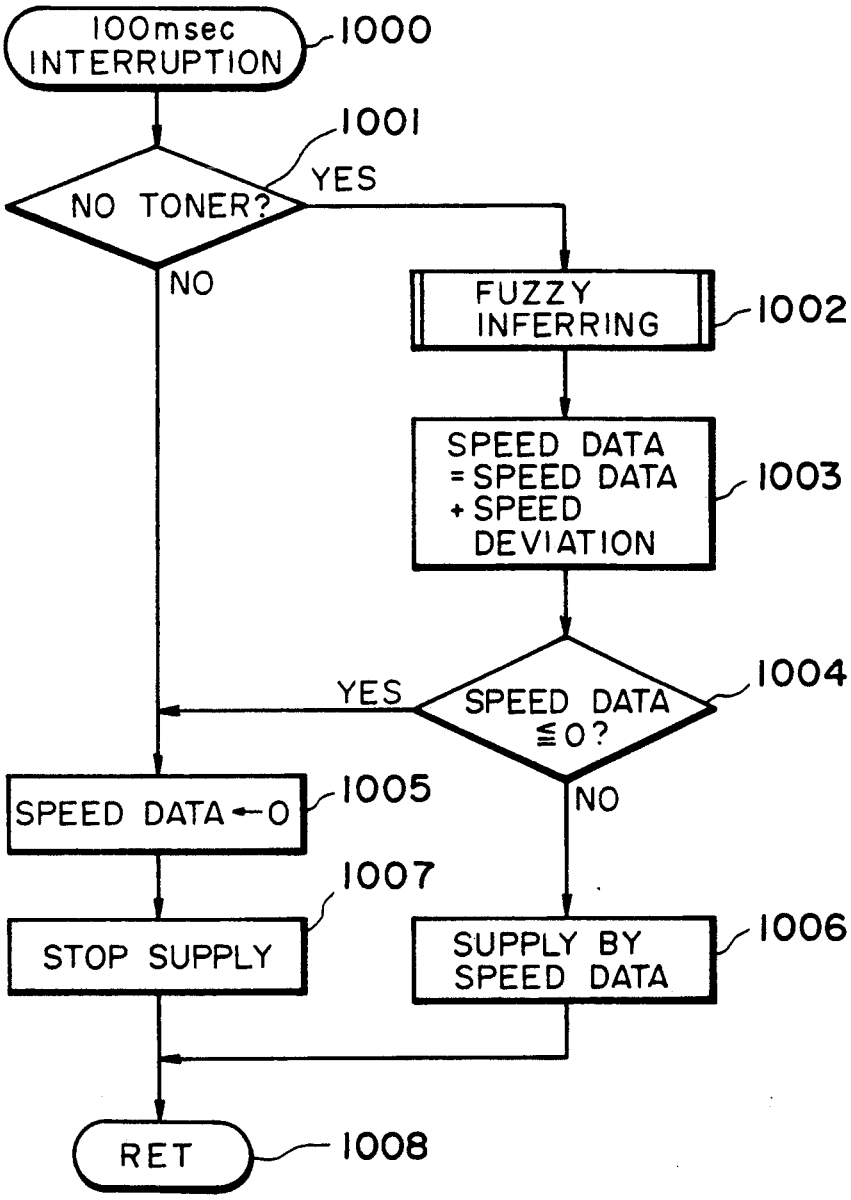
FIGS. 5 and 6 are control flowcharts according to the embodiment of the invention.

Next, referring to a flowchart shown in FIG. 5, the overall operation flow will be explained.

An interruption is made every 100 msec in Step 1000, and the amount (density) of the toner, which is detected by the sensor 817, is measured, compared with a predetermined regulated amount (density) of the toner, and then checked in Step 1001.

Figure 6:
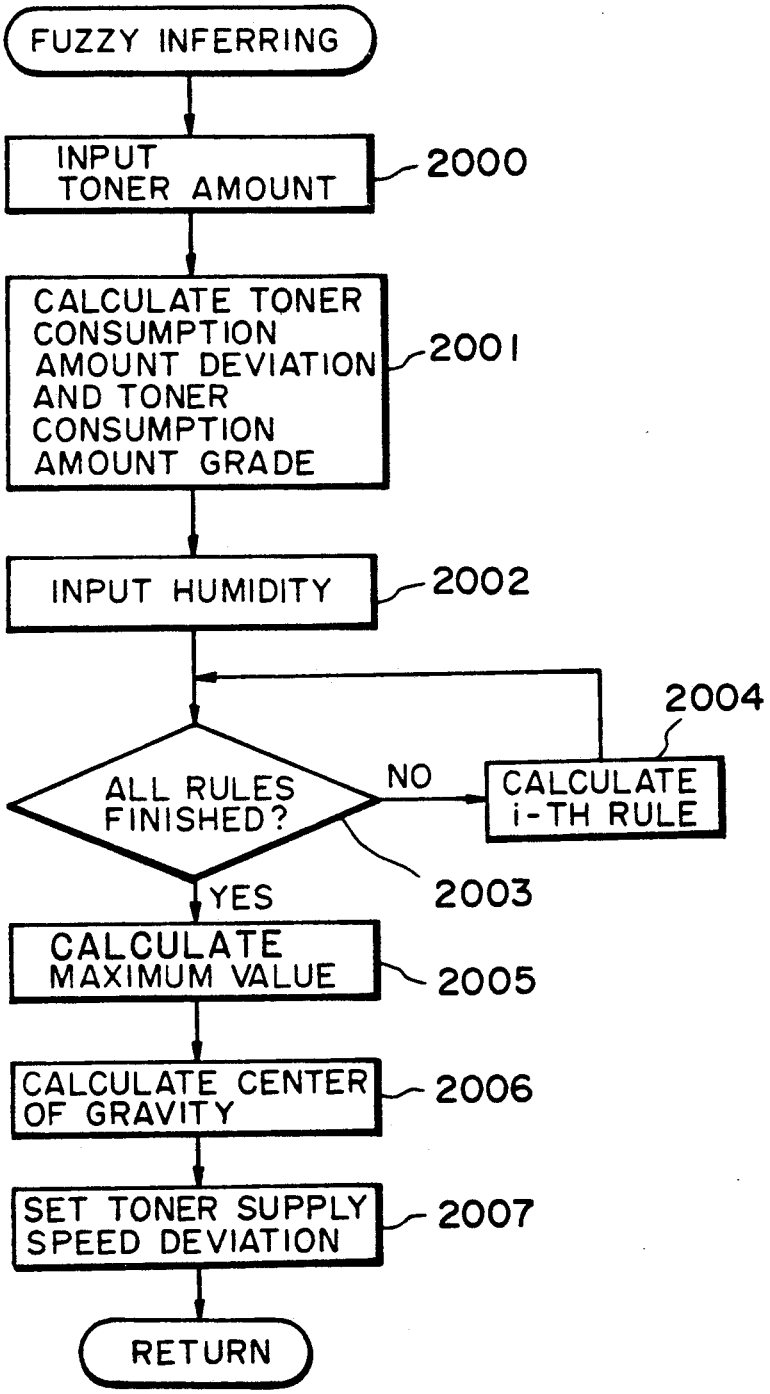

When no toner exists (the toner density is lower than the regulated density), a subroutine of fuzzy inferring shown in FIG. 6 is called and the toner supply speed deviation is set in Step 1002.

As shown in FIG. 6, the amount (density) of the toner is measured in the same manner as described above in Step 2000, and the difference between the measured amount (density) and the predetermined regulated amount (density) of the toner is calculated as the toner consumption deviation, and the difference between the previous (0.1 second before) toner consumption deviation and the present toner consumption deviation is calculated as the toner consumption grade (g/0.1 sec) in Step 2001. The grade corresponds to a quantity which affects the toner consumption speed, such as the density of a document to be copied, the size of copying sheet and so on.

The humidity is measured by the humidity sensor 816 in Step 2002, and for all the fuzzy rules shown in Table 1, the degree to which the control quantity belongs to the fuzzy set is calculated from the degree to which the state quantity belongs to the fuzzy set according to each fuzzy rule in the above-described manner by the CPU 801 in Steps 2003 and 2004.

The maximum value of the sets which belong to each rule is calculated in Step 2005, the center of gravity of the control quantity having the highest probability is calculated in Step 2006, and the center of gravity is set as the toner supply speed deviation in Step 2007.

Returning to FIG. 5, the speed deviation set by the fuzzy inferring in Step 1002 is added to the previous speed data in Step 1003. If the speed data is equal to or less than 0 in Step 1004, the speed data is set to 0 in Step 1005 and the toner supply is stopped in Step 1007.

If the speed data is more than 0 in Step 1004, the toner is supplied by switching the duty ratio of the above-described PWM signal according to the speed data in Step 1006.

If the toner exists (the toner density is more than the regulated value) in Step 1001, the speed data is 0 in Step 1005 and the toner supply is stopped in Step 1007.

In the above first embodiment, the detected toner density is compared with the standard toner density and the toner supply speed is controlled in the fuzzy manner in accordance with various state quantities in the toner density detection device. Besides that, it is also possible to use a control means for changing the standard toner density, with which the measured toner density is compared, within a range, instead of controlling the toner supply speed according to the state quantity.

In particular, it is well known that the development characteristics of the developer vary in accordance with environmental quantities. Specifically, since the amount of charges in the toner of the developer increases when the humidity is low, the development characteristics are remarkably lowered. On the other hand, when the humidity is high, the amount of the charges in the toner decreases and the binding force with the carrier is lowered, and therefore the development characteristics are increased and, in an extreme case, blooming is caused.

Accordingly, an almost constant image density can be maintained in any environment by heightening the standard toner amount (density) level at low humidity to enhance the development characteristics and making the contrary control at high humidity.

This phenomenon is relative not only to humidity but also to the document density and so on. In other words, if the document density is high, the toner consumption grade is steep and a new toner is always supplied. Therefore, the amount of charges in the toner is decreased. If the document density is low, since the toner is not so highly consumed (the toner consumption grade is gentle), the amount of charges in the toner is increased and the development characteristics are lowered. It is required to make the same control on the phenomenon and a stable image density can be maintained by the above-mentioned control manner.

The state quantity is of the following two types:

(i) Toner consumption grade which is a change in the amount of toner consumption per unit time (ii) Humidity inside of the image forming apparatus.

Needless to say, (i) is a quantity relative to the document density, the size of paper and so on.

As the control quantity in controlling the toner density detection device:

(iii) Standard toner amount deviation stored in the CPU of the main body of the apparatus is used.

Figure 7A:
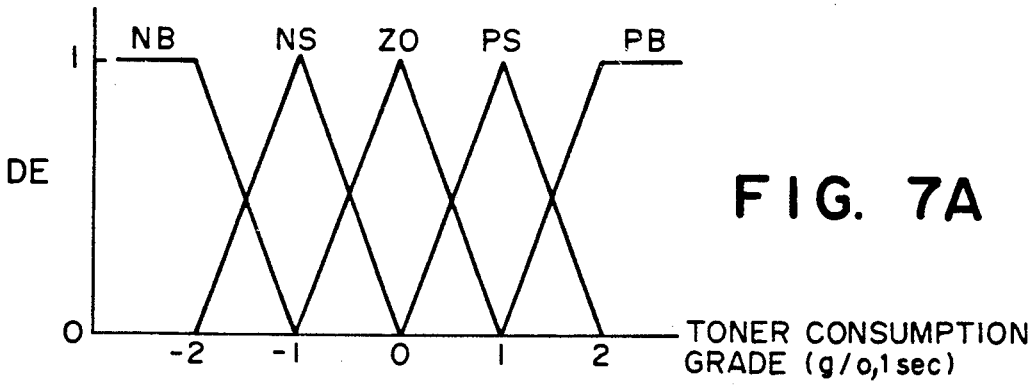
FIGS. 7A to 7C are views explaining other membership functions.
Figure 7B:
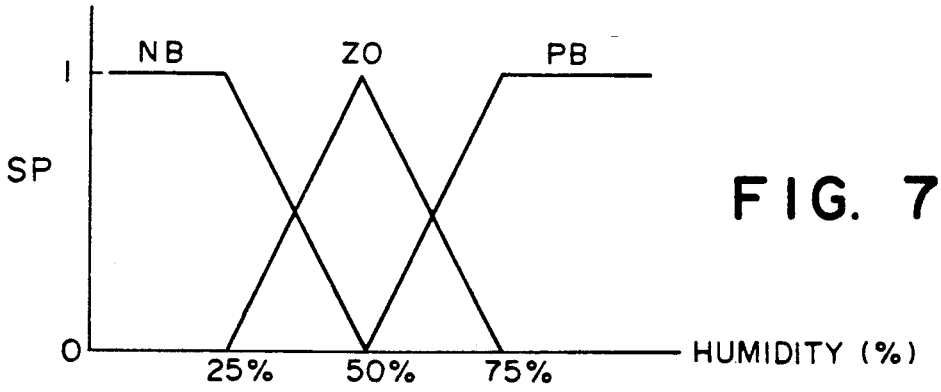
Figure 7C:
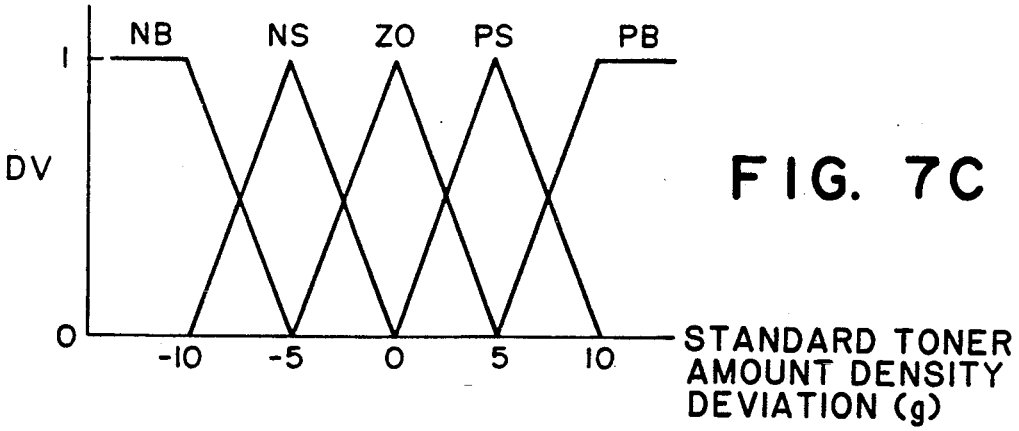

Fuzzy sets called as the membership functions of the above state and control quantities (i) to (iii) are shown in FIGS. 7A, 7B and 7C.

The toner consumption, the inside humidity and the standard toner amount deviation are divided into several sets. For example, the toner consumption grade is divided into the following sets:

1) NB (Negative Big)
A negative value whose absolute value is large
2) NS (Negative Small)
A negative value whose absolute value is small
3) ZO (Zero)
A value near 0
4) PS (Positive Small)
A positive value whose absolute value is small
5) PB (Positive Big)
A positive value whose absolute value is large The degree to which a quantity belongs to each set is indicated by a value 0 to 1. FIG. 7A shows a membership function of the toner consumption deviation, FIG. 7B shows a membership function of the inside humidity, and FIG. 7C shows a membership function of the standard toner amount deviation.

Taking ZO (Zero) shown in FIG. 7A as an example, when the toner consumption deviation is 0 g/0.1 sec, the degree to which it belongs is 1. When the toner consumption deviation is −0.5 g/0.1 sec or +0.5 g/0.1 sec, the degree is 0.5. Other sets are the same as ZO. Next, a method of calculating the standard toner amount deviation from the state quantities of the toner consumption grade and the inside humidity will be described. In order to determine the standard toner amount deviation, for example, the following fuzzy rules are used:

(Rule 1)
If the toner consumption deviation=PB and the inside humidity=ZO,
then, the standard toner amount (density) deviation=PB.

(Rule 2)
If the toner consumption deviation=PS and the inside humidity=NB,
then, the standard toner amount (density) deviation=ZO.

Thus, the fuzzy rules are set according to requirements. The fuzzy rules between the first subject and the second subject in this case are shown in Table 2:

TABLE 2

| | DE | | | | |
|---|---|---|---|---|---|
| SP | NB | NS | ZO | PS | PB |
| NB | PB | PS | PS | ZO | NS |
| ZO | PS | PS | ZO | NS | NS |

TABLE 2-continued

| | DE | | | | |
|---|---|---|---|---|---|
| SP | NB | NS | ZO | PS | PB |
| PB | PS | ZO | NS | NS | NB |

Figure 8:
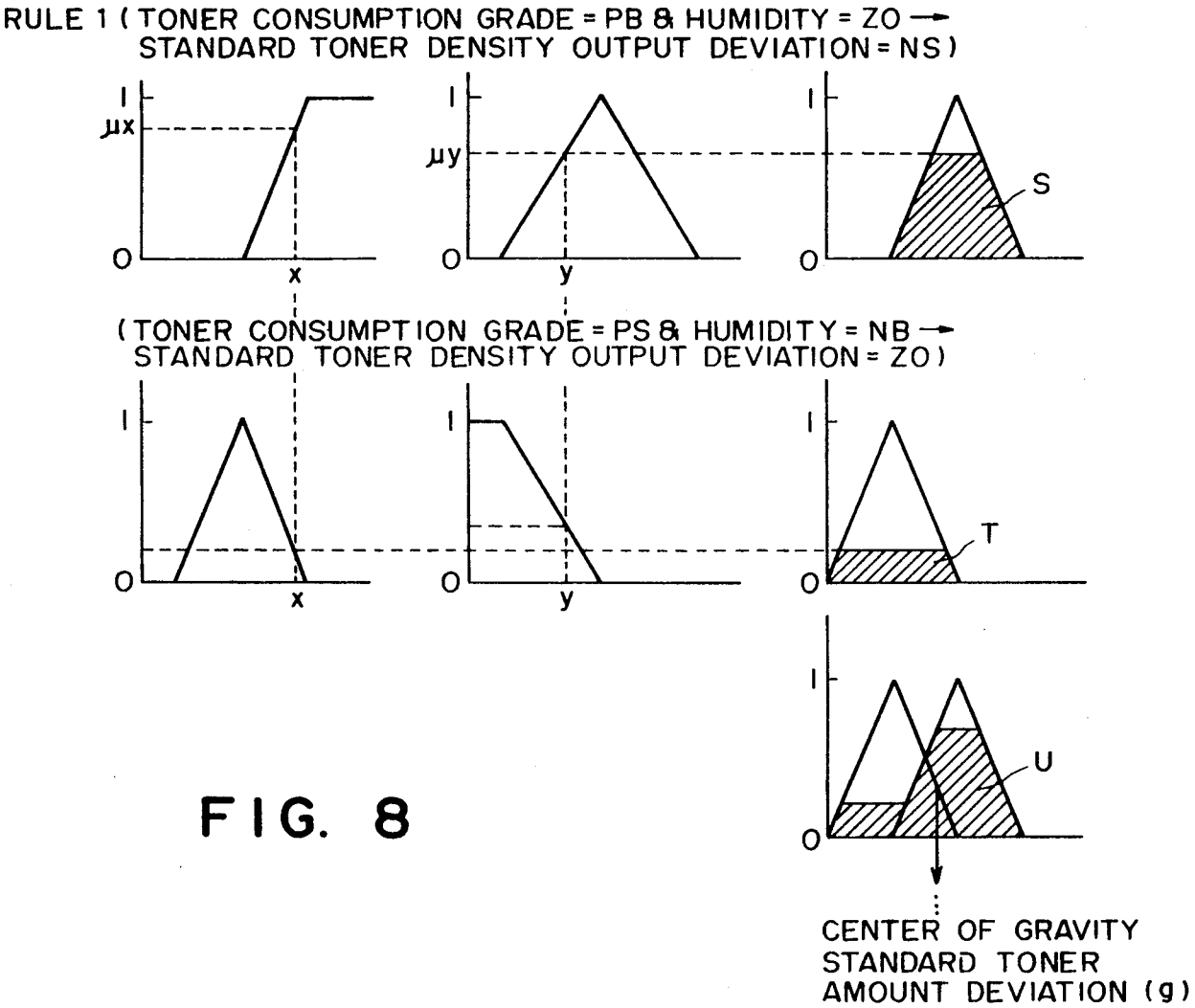
FIG. 8 is a view explaining another calculation.

FIG. 8 shows an example of calculating the standard toner amount (density) deviation by the fuzzy inferring with the above Rule 1 and Rule 2. The case that the toner consumption deviation=x and the inside humidity=y is taken as an example. In Rule 1, the degree to which input x is contained in the set PB is $\mu x$ according to the membership function of the toner consumption deviation and the degree to the membership function of the inside humidity.

Then, if the minimum value is selected from $\mu x$ and $\mu y$, a calculation is performed so as to find the minimum value of the above value and the membership function of the standard toner amount deviation, and then, a shaded trapezoid portion S is obtained.

The same calculation is also executed in Rule 2 and a shaded trapezoid portion T is obtained. After that, by combining the sets S and T and selecting the maximum value of the combined set, a new set, shown as a shaded portion U, is obtained. A value obtained by calculating the center of gravity of the set is set as the standard toner amount (density) deviation obtained by the fuzzy inferring.

In order to make the explanation brief, FIG. 8 shows an example wherein the calculation is performed for only Rules 1 and 2. However, the calculation is actually performed for each rule shown in Table 2 to finally find the center of gravity, as described above.

Figure 9:
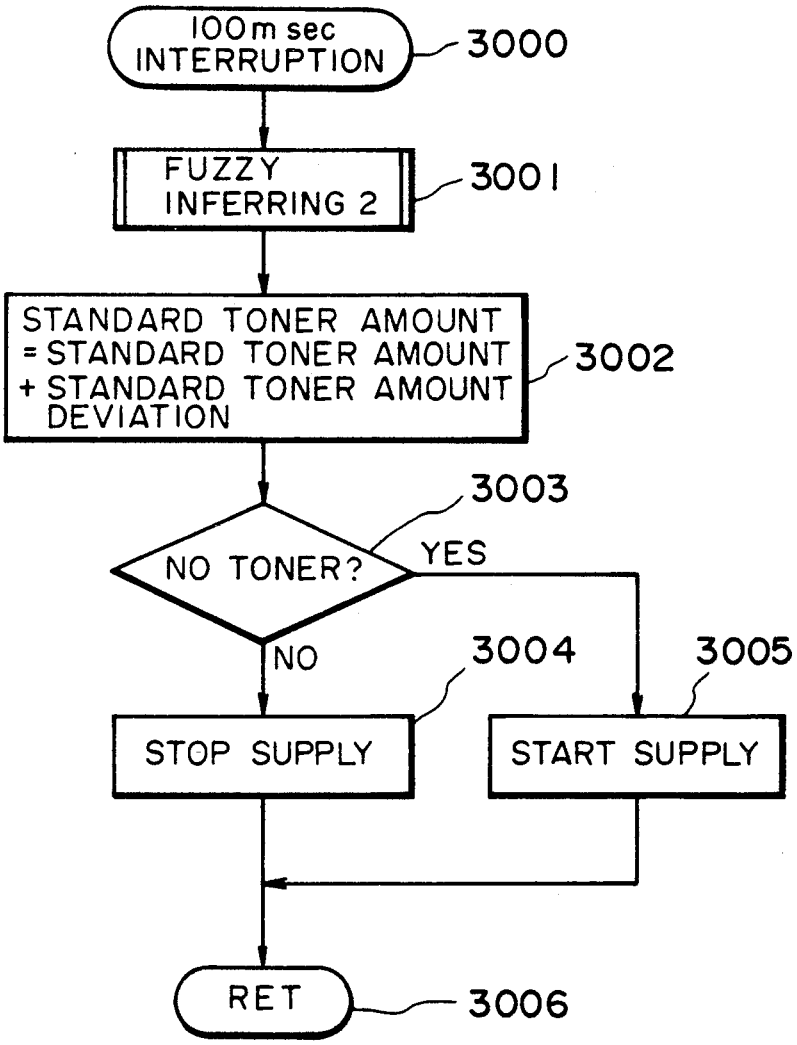
FIGS. 9 and 10 are control flowcharts according to another embodiment of the present invention.
Figure 10:
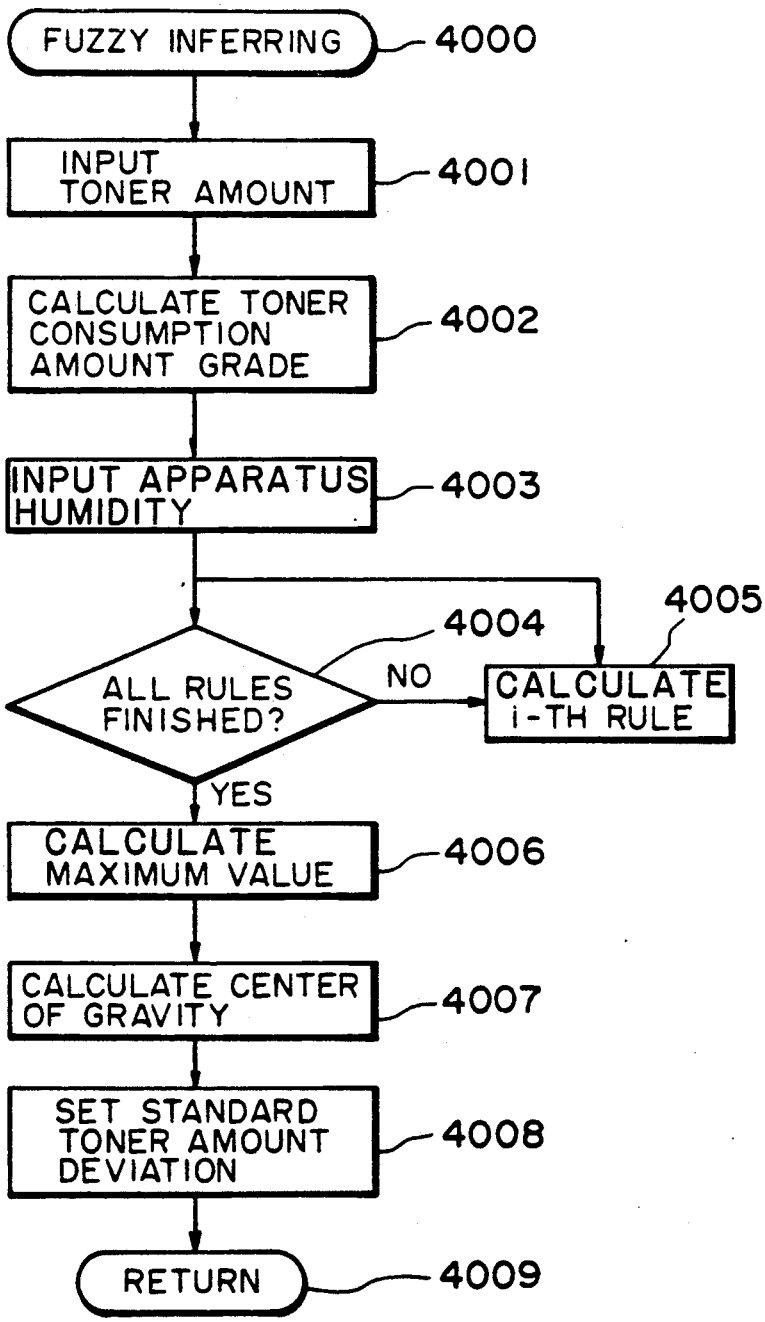

Before explaining the flow of the overall operation with reference to the flowchart shown in FIG. 9, fuzzy inferring 2, which is a subroutine used in FIG. 9, will be described according to FIG. 10.

The toner amount (density) is measured in Step 4001 and the difference between the present toner amount (density) and the previous amount is calculated as the toner consumption amount deviation. The difference between the previous (0.1 second before) toner consumption amount deviation and the present deviation is calculated as the toner consumption amount grade in Step 4002.

The humidity is measured by the humidity sensor 816 in Step 4003, and for all the fuzzy rules shown in Table 2, the degree to which the control quantity belongs to the fuzzy set is calculated from the degree to which the state quantity belongs to the fuzzy set according to each fuzzy rule in the above-described manner in Steps 4004 and 4005.

The maximum value of the sets which belong to each rule is calculated in Step 4006, the center of gravity of the control quantity having the highest probability is calculated in Step 4007, and the center of gravity is set as the standard toner amount (density) deviation in Step 4008.

Returning to FIG. 9, the standard toner amount (density) deviation set by the fuzzy inferring in Step 3001 is added to the previous standard amount (density) in Step 3002. The detected toner amount (density) is compared with the standard toner amount (density) found in Step 3002 in Step 3003 and it is judged whether or not the toner exists (whether the toner density is higher or lower than the standard value). If no toner exists, the toner supply is started in Step 3005, and if the toner exists, the toner supply is stopped in step 3004.

As described above, the fuzzy theory is explained as an application of the toner speed control in the first embodiment, and as an application of the standard toner amount (density) control in the second embodiment. By simultaneously controlling the toner supply speed and the standard toner amount (density) in the same manner, a stabler image quality and a higher durability can be obtained.

Figure 11:
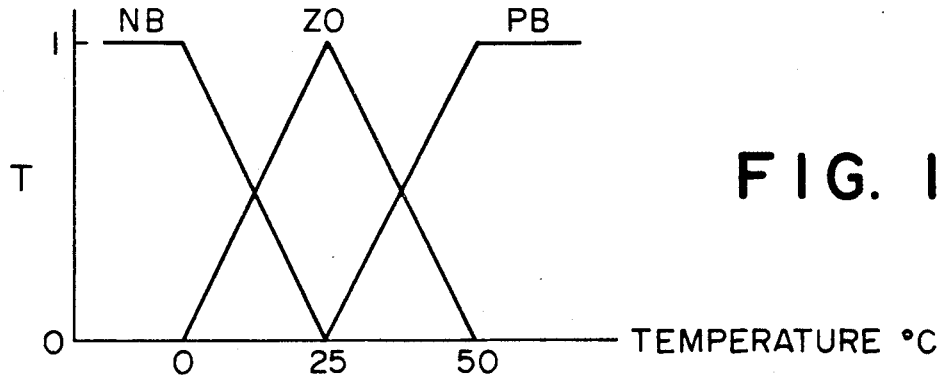
FIGS. 11, 12 and 13 are views explaining still other membership functions.

Furthermore, even if there are state quantities, other than the state quantities described in the above embodiments, such as the temperature or deterioration degree of the developer, either there is no problem, or controllability seems to be enhanced. Specifically, as an application of the toner amount control when temperature is added to the state quantities of the toner consumption amount deviation and the humidity, FIG. 11 shows a membership function (T) of the temperature and Table 3 shows a fuzzy rule between the temperature and the toner consumption amount deviation. The temperature characteristics of the toner show a tendency, that is, the lower the temperature is, the higher the flowability of the toner is and the larger the amount of toner charges is, and the development characteristics are lowered. Therefore, unless the standard toner amount (density) is somewhat increased in accordance with the lowering of the development characteristics, a proper toner density cannot be maintained. If the temperature rises, then, since it approaches the glass transition point of the resin component of the toner, the flowability is lowered, the toner charge amount tends to be decreased, and this causes a problem, such as blooming. Therefore, it is preferable to somewhat decrease the standard toner amount (density).

A fuzzy rule shown in Table 3 is determined by the above tendency.

In Table 3, DE is the same as shown in FIG. 7A and Dv is the same as shown in FIG. 7C.

TABLE 3

| | DE | | | | |
|---|---|---|---|---|---|
| T | NB | NS | ZO | PS | PB |
| NB | PS | ZO | ZO | ZO | NS |
| ZO | PS | ZO | ZO | ZO | NS |
| PB | ZO | ZO | ZO | NS | NS |

Furthermore, the fuzzy rule between the temperature and the humidity is shown in Table 4. Since the toner characteristics relative to the temperature are the same as described above and the humidity has a greater influence on the toner characteristics than the temperature, it is preferable to make the fuzzy rule as shown in Table 4. SP shown in Table 4 may be the same as shown in FIG. 7B and DB may be the same as shown in FIG. 7C.

TABLE 4

| | SP | | |
|---|---|---|---|
| T | NB | ZO | PB |
| NB | PS | ZO | NS |
| ZO | PS | ZO | NS |
| PB | ZO | ZO | NS |

Next, the deterioration degree of the developer will be described as another state quantity. In order to control the standard toner amount, the deterioration degree of the developer is inferred from the total copy sheet number (as taken from a copy sheet counter) and a copy sheet number deviation, that is, the copy operation condition.

Figure 12:
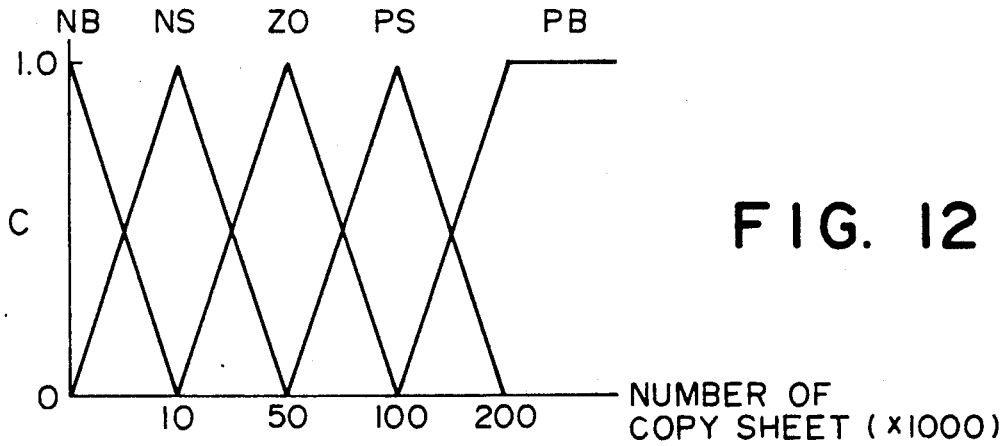
Figure 13:
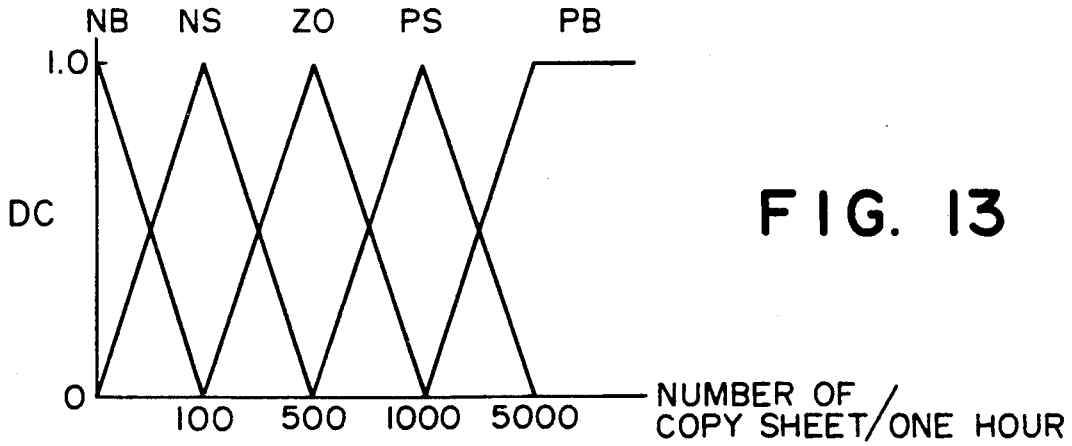

FIG. 12 shows a membership function of the number of copy sheet and FIG. 13 shows a membership function of the number of copy sheet per unit time (one hour).

In Table 5, the fuzzy rule between the total copy sheet number and the copy sheet number deviation is shown.

TABLE 5

| | C | | | | |
|---|---|---|---|---|---|
| DC | NB | NS | ZO | PS | PB |
| NB | ZO | ZO | ZO | ZO | PS |
| NS | ZO | ZO | ZO | PS | PS |
| ZO | ZO | PS | PS | PS | PB |
| PS | PS | PS | PS | PB | PB |
| PB | PS | PS | PB | PB | PB |

As for the deterioration of the developer, the development characteristics (image density) are lowered in almost direct proportion to the total copy sheet number (that is, the time in use of the image forming apparatus). This is because, in the case of the two-component developer, an increase in the charge of the toner, the contamination (fusion of the toner) of or damage to the surface of the carrier or the like prevents the toner from being sufficiently held. In the case of the one-component developer, the transport force of the toner is lowered by any increase in the charge of the toner, the abrasion or contamination of the surface of the sleeve or the like. Therefore, it is required to somewhat increase the standard toner amount (density).

The copy sheet number deviation is a quantity which shows the operation condition of the developer. As the copy sheet number deviation rises, the amount of the charge of the developer is increased and the development characteristics are lowered. If a long rest period is given, the charge dissipates, the amount of the charge returns to the proper amount, and therefore the development characteristics are enhanced. The fuzzy rule shown in Table 5 is determined in accordance with the above relationships.

In the same way as the above, Table 6 shows a fuzzy rule representing the relationship between the toner consumption grade and the total copy sheet number, Table 7 shows a fuzzy rule between the toner consumption grade and the copy sheet number deviation, Table 8 shows a fuzzy rule representing the relationship between the humidity and the total copy sheet number, and Table 9 shows a fuzzy rule between the humidity and the copy sheet number deviation.

In each table, DE, SP and DV may be the same as shown in FIG. 7 and the second subject of the rule is DV.

TABLE 6

| | C | | | | |
|---|---|---|---|---|---|
| DE | NB | NS | ZO | PS | PB |
| NB | ZO | ZO | PS | PB | PB |
| NS | ZO | ZO | PS | PS | PB |
| ZO | ZO | ZO | ZO | PS | PS |
| PS | NS | NS | ZO | ZO | ZO |
| PB | NB | NS | NS | ZO | ZO |

TABLE 7

| | DC | | | | |
|---|---|---|---|---|---|
| DE | NB | NS | ZO | PS | PB |
| NB | ZO | PS | PS | PB | PB |
| NS | ZO | ZO | PS | PS | PB |
| ZO | ZO | ZO | ZO | PS | PS |
| PS | NS | NS | ZO | ZO | ZO |
| PB | NB | NS | NS | ZO | ZO |

TABLE 8

| | C | | | | |
|---|---|---|---|---|---|
| SP | NB | NS | ZO | PS | PB |
| NB | ZO | PS | PS | PB | PB |
| ZO | ZO | ZO | PS | PS | PB |
| PB | NS | NS | ZO | ZO | PS |

TABLE 9

| | DC | | | | |
|---|---|---|---|---|---|
| SP | NB | NS | ZO | PS | PB |
| NB | ZO | PS | PS | PB | PB |
| ZO | ZO | ZO | PS | PS | PS |
| PB | NS | NS | ZO | ZO | PS |

The fuzzy inferring and the calculation of the center of gravity based on each table are performed in the same manner as described above. Since the flowcharts are also the same as shown in FIGS. 9 and 10, they are omitted to avoid complexity.

Though in each of the above embodiments the supply of the toner component in the two-component developer is described as an example, the present invention can be applied to the supply of the one-component developer, such as a magnetic toner. Besides the state quantities described above, other state quantities, which are peculiar to an applied apparatus or proper for a use condition, may be selected.

According to the present invention, as shown described above, the stability of the image and the reliability of image forming are directly enhanced by properly controlling the supply of developer. As a result, high reliability and durability not only of the developing device but also of the image forming apparatus, which uses the developing device, can be obtained.

We claim:

1. An image forming apparatus, comprising:

a developer for developing an electrostatic latent image by supplying a toner to an image bearing body;

a toner reservoir for holding the toner therein;

toner supplement means for supplementing the toner from said toner reservoir to said developer; and control means for controlling said toner supplement means to control an amount of toner supplemented to said developer, said control means controlling said toner supplement means in accordance with a plurality of state quantities comprising at least two of temperature inside said apparatus, humidity inside said apparatus, deviation of toner quantity in said developer relative to a reference toner quantity, toner consumption quantity per unit time, total number of copy sheets copied and a number of copy sheet copied per unit time, said control means having memory means for storing a first fuzzy set relating to each of the plurality of state quantities, a second fuzzy set relating to the control of said toner supplement means and a fuzzy rule among the plurality of state quantities and a control quantity, and calculation means for calculating the amount of toner to be supplemented, from the plurality of state quantities based on the first and second fuzzy sets and the fuzzy rule.

2. An image forming apparatus according to claim 1, wherein said control means controls a toner supplement speed of said toner supplement means.

3. An image forming apparatus according to claim 1, further comprising detection means for detecting toner quantity in said developer, wherein said control means controls said toner supplement means in response to a difference between a toner quantity value detected by said detection means and a reference toner quantity, said control means controlling the reference toner quantity value.

4. An image forming apparatus according to claims 1, 2 or 3, wherein said developer contains a developing agent comprising a toner and a carrier.

5. An image forming apparatus, comprising:

a developer for developing an electrostatic latent image by supplying a toner to an image bearing body;

a toner reservoir for holding the toner therein;

toner supplement means for supplementing the toner from said toner reservoir to said developer; and control means for controlling said toner supplement means to control an amount of toner supplemented to said developer, said control means controlling said toner supplement means in accordance with the humidity inside said apparatus and at least one of other state quantities that affect the developed image, wherein said control means comprises memory means for storing a first fuzzy set relating to humidity, a second fuzzy set relating to at least one of other state quantities, a third fuzzy set relating to the control of said toner supplement means and a fuzzy rule among the humidity, at least one of other state quantities and a control quantity, and calculation means for calculating the amount of toner to be supplemented from the humidity and at least one of other state quantities based on the first, second and third fuzzy sets and the fuzzy rule.

6. An image forming apparatus according to claim 5, wherein said control means controls a toner supplement speed of said toner supplement means.

7. An image forming apparatus according to claim 6, wherein said developer comprises a developing agent including a toner and a carrier.

8. An image forming apparatus according to claim 5, further comprising detection means for detecting toner quality in said developer, wherein said control means controls said toner supplement means in response to a difference between a toner quantity value detected by said detection means and a reference toner quantity, said control means controlling the toner reference quantity value.

9. An image forming apparatus according to claim 8, wherein said developer comprises a developing agent including a toner and a carrier.

10. An image forming apparatus according to claim 8, wherein the other state quantities comprise a deviation of toner quantity in said developer relative to a reference toner quantity, toner consumption quantity per unit time, total number of copy sheets copied, number of copy sheets copied per unit time and temperature inside said apparatus.

11. An image forming apparatus, comprising:
a developer for developing an electrostatic latent image by supplying a developing agent comprising a toner and a carrier to an image bearing body;
a toner reservoir for holding the toner therein;
toner supplement means for supplementing the toner from said toner reservoir to said developer;
detection means for detecting a toner density; and
control means for controlling said toner supplement means in response to a difference between a toner density value detected by said detection means and a reference toner density value, said control means controlling the reference toner density value in accordance with humidity inside said apparatus and other state quantity that affect the developed image,
wherein said control means includes memory means for storing a first fuzzy set relating to the humidity, a second fuzzy set relating to the other state quantity, a third fuzzy set relating to the reference toner density value, a fuzzy rule among the humidity, the other state quantity and the reference toner density value, and calculation means for calculating the reference toner density value from the humidity and the other state quantity, based on the first, second and third fuzzy sets and the fuzzy rule.

12. An image forming apparatus according to claim 11, wherein the other state quantity comprises deviation of toner density in the developer relative to the reference toner density, toner consumption quantity per unit time, total number of copy sheets copied, number of copy sheets copied per unit time and temperature inside said apparatus.

13. An image forming apparatus, comprising:
a developer for developing an electrostatic latent image by supplying a developing agent comprising a toner and a carrier to an image bearing body;
a toner reservoir for holding the toner therein;
toner supplement means for supplementing the toner from said toner reservoir to said developer;
detection means for detecting a toner density of the developing agent; and
control means for controlling said toner supplement means in response to a difference between a toner density value detected by said detection means and a reference toner density value, said control means controlling the reference toner density value in accordance with a first information relating to the total number of copy sheets coped and a second information relating to the number of copy sheets copied per unit time,
wherein said control means comprises memory means for storing a first fuzzy set relating to the total number of copy sheet copied, a second fuzzy set relating to the number of copy sheets copied per unit time, a fuzzy rule among the total number of copy sheets copied, a number of copy sheets copied per unit time and the reference toner density value, and calculation means for calculating the reference toner density value based on the first and second fuzzy sets and fuzzy rule from the first and second informations.

14. An image forming apparatus, comprising:
a developer for developing an electrostatic latent image by supplying a developing agent comprising a toner and a carrier to an image bearing body;
a toner reservoir for holding the toner therein;
toner supplement means for supplementing the toner from said toner reservoir to said developer;
detection means for detecting a toner density;
control means for controlling said toner supplement means in response to a difference between a toner density value detected by said detection means and a reference toner density value, said control means controlling the reference toner density value in accordance with a first information relating to a toner consumption quantity per unit time and a second information relating to a total number of copy sheets copied,
wherein said control means comprises a memory means for storing a first fuzzy set relating to toner consumption quantity per unit time, a second fuzzy set relating to the total number of copy sheets copied, a third fuzzy set relating to the reference toner density value and a fuzzy rule among the toner consumption quantity per unit time, total number of copy sheets copied and the reference toner density value, and calculation means for calculating the reference toner density value from the first and second informations based on the first, second and third fuzzy sets and the fuzzy rule.

15. An image forming apparatus, comprising:
a developer for developing an electrostatic latent image by supplying a developing agent comprising toner and a carrier;
a toner reservoir for holding the toner therein;
toner supplement means for supplementing the toner from said toner reservoir to said developer;
detection means for detecting a toner density of the developing agent; and
control means for controlling said toner supplement means in response to a difference between a toner density value detected by said detection means and a reference toner density value, said control means controlling the reference toner density value in accordance with a first information relating to a toner number of sheets copied per unit time and a second information relating to toner consumption quantity per unit time,
wherein said control means comprises memory means for storing a first fuzzy set relating to the total number of copy sheets copied per unit time, a second fuzzy set relating to the toner consumption quantity per unit time, a third fuzzy set relating to the reference toner density value, and a fuzzy rule among the total number of copy sheets copied per unit time, toner consumption quantity per unit time and the reference toner density value, and calculation means for calculating the reference toner density value from the first and second informations based on the first, second and third fuzzy sets and the fuzzy rule.

16. An image forming apparatus, comprising:
a developer for developing an electrostatic latent image by supplying a developing agent comprising a toner and a carrier to an image bearing body;
a toner reservoir for holding the toner therein;
supplement means for supplementing a toner from said toner reservoir to said developer;
detection means for detecting a toner density of the developing agent; and
control means for controlling said toner supplement means in response to a difference between a toner density value detected by said detection means and a reference toner density value, said control means controlling a toner supplement speed in accordance with a first information relating to humidity inside said apparatus, a second information relating to the difference between the detected toner density value and the reference toner density value and a third information relating to the toner consumption quantity per unit time, wherein said control means comprises memory means for storing a first fuzzy set relating to the difference between the detected toner density value and the reference toner density value, a second fuzzy set relating to the toner consumption quantity per unit time, a third fuzzy set relating to the toner supplement speed, a fourth fuzzy set relating to the humidity inside said image forming apparatus, a fuzzy rule among the difference between the detected toner density value and the reference toner density value, humidity and toner consumption quantity per unit time and the toner supplement speed, and calculation means for calculating the toner supplement speed from the first, second and third informations based on the first, second, third and fourth fuzzy sets and the fuzzy rule.

* * * * *

UNITED STATES PATENT AND TRADEMARK OFFICE

CERTIFICATE OF CORRECTION

PATENT NO. : 5,142,332

DATED : August 25, 1992

INVENTOR(S) : KEISHI OSAWA, ET AL.

It is certified that error appears in the above-identified patent and that said Letters Patent is hereby corrected as shown below:

ON THE TITLE PAGE,

ABSTRACT [57]

Line 4, "use" should read --uses--.

SHEET 1/FIG. 1

"CRICUIT" should read --CIRCUIT--.

COLUMN 7

Line 32, "The" should read --. The--.

COLUMN 11

Line 64, "sheet" should read --sheets--.

COLUMN 12

Line 17, "claims" should read --claim--.

UNITED STATES PATENT AND TRADEMARK OFFICE

CERTIFICATE OF CORRECTION

PATENT NO. : 5,142,332

DATED : August 25, 1992

INVENTOR(S) : KEISHI OSAWA, ET AL.

It is certified that error appears in the above-identified patent and that said Letters Patent is hereby corrected as shown below:

COLUMN 13

Line 50, "coped" should read --copied--.
Line 55, "sheet" should read --sheets--.

COLUMN 14

Line 3, "density;" should read --density; and--.
Line 40, "toner" should read --total--.

Signed and Sealed this

Twelfth Day of October, 1993

*Attest:*

*Attesting Officer*

BRUCE LEHMAN

*Commissioner of Patents and Trademarks*